US009943741B2

(12) United States Patent
McMahon, Jr.

(10) Patent No.: US 9,943,741 B2
(45) Date of Patent: Apr. 17, 2018

(54) PRACTICE HOCKEY GOALTENDERS

(71) Applicant: James F. McMahon, Jr., Slingerlands, NY (US)

(72) Inventor: James F. McMahon, Jr., Slingerlands, NY (US)

( * ) Notice: Subject to any disclaimer, the term of this patent is extended or adjusted under 35 U.S.C. 154(b) by 5 days.

(21) Appl. No.: 14/658,961

(22) Filed: Mar. 16, 2015

(65) Prior Publication Data

US 2016/0271472 A1 Sep. 22, 2016

(51) Int. Cl.

| | |
|---|---|
| ***A63B 69/00*** | (2006.01) |
| ***A63B 69/34*** | (2006.01) |
| *A63B 71/02* | (2006.01) |

(52) U.S. Cl.

CPC ..... *A63B 69/0026* (2013.01); *A63B 69/34* (2013.01); *A63B 2071/024* (2013.01)

(58) Field of Classification Search

CPC ..... A63B 69/34; A63B 69/36
USPC ..... 473/446
See application file for complete search history.

(56) References Cited

U.S. PATENT DOCUMENTS

| | | | | |
|---|---|---|---|---|
| 3,765,675 | A | 10/1973 | DiMarzio | |
| 4,489,940 | A | 12/1984 | Amundson | |
| 5,246,229 | A | 9/1993 | Carey | |
| 5,465,958 | A | 11/1995 | Brun | |
| 5,498,000 | A | 3/1996 | Cuneo | |
| D368,500 | S * | 4/1996 | Parzino | D21/699 |
| 5,582,404 | A | 12/1996 | Parzino | |
| 5,647,747 | A | 7/1997 | Macri et al. | |
| 5,772,538 | A * | 6/1998 | Sztykiel | A63B 63/00 473/446 |
| 5,776,019 | A | 7/1998 | Kronenberger | |
| D405,485 | S | 2/1999 | Mathison | |
| 6,012,994 | A * | 1/2000 | Beluse | A63B 69/0026 473/446 |
| D466,825 | S | 12/2002 | Ettridge et al. | |
| 6,595,878 | B1 | 7/2003 | Nelson | |
| D495,385 | S | 8/2004 | Winger | |
| 6,796,914 | B2 | 9/2004 | Berdugo et al. | |

(Continued)

OTHER PUBLICATIONS

Rick O Shay Goal Blocker, available from HockeyShot.com, print-out available online on Apr. 10, 2015, at http://www.hockeyshot.com/Rick-O-Shay-Goal-Blocker-p/target-tarp-013.htm, 7-pages, at least as early as Sep. 2, 2012.

(Continued)

*Primary Examiner* — Christopher Glenn
(74) *Attorney, Agent, or Firm* — Heslin Rothenberg Farley & Mesiti P.C.

(57) ABSTRACT

Practice hockey goaltenders, positionable on a playing surface in front of a hockey goal, include a generally three-dimensional representation of a life-size hockey goaltender disposed in a playing position having a front side and a rear side. The generally rigid three-dimensional representation represents a padded left leg, a padded right leg, a hockey stick, a blocker, a catcher, a torso, and a mask. The practice hockey goaltender includes rearwardly-extending supports, releasably attachable spikes, a weight distribution so that it is supportable in an angled forward orientation on a forwardly and upwardly-extending bottom surface portion, an appearance of being formed from plate-like components, and/or a hollow monolithic structure.

32 Claims, 12 Drawing Sheets

(56) References Cited

U.S. PATENT DOCUMENTS

| | | | | |
|---|---|---|---|---|
| 6,796,915 | B2 * | 9/2004 | Getchell | A63B 69/0024 473/438 |
| 6,926,624 | B1 | 8/2005 | Witzke | |
| D516,629 | S * | 3/2006 | McDonald | D20/31 |
| 7,156,760 | B2 | 1/2007 | Berdugo et al. | |
| 7,651,416 | B2 | 1/2010 | Farquhar | |
| 8,128,518 | B1 | 3/2012 | Kudla et al. | |
| 2006/0019775 | A1 | 1/2006 | Nurthen | |
| 2007/0060419 | A1 * | 3/2007 | Hutton | A63B 69/00 473/446 |
| 2015/0190693 | A1 | 7/2015 | Gilman et al. | |

OTHER PUBLICATIONS

James F. McMahon, Jr., pending Design U.S. Appl. No. 29/520,573, filed Mar. 16, 2015, "Practice Hockey Goaltender", 8-pages.

Mylec 3D Mini Goalie Hockey Buddy, available from Amazon.com, printout available online on Mar. 4, 2015, at http://www.amazon.com/Mylec-Mini-Goalie-Hockey-Buddy/dp/B000LGZVSE/ref=sr_1_9?ie=UTF8&qid=1393594204&sr=8-9&keywords=hockey+goalie+training, 6-pages, at least as early as Dec. 25, 2010.

Ultimate Goalie, available from Sniper's Edge Hockey, printout available online on Mar. 4, 2015, at http://www.snipersedgehockey.com/products/ultimate-goalie-hockey-single, 4-pages, at least as early as Dec. 23, 2014.

Shooting Packages, available from Sniper's Edge Hockey, printout available online on Mar. 4, 2015, at http://www.snipersedgehockey.com/collections/hockey-shooting-packages, 4-pages, at least as early as Dec. 23, 2014.

Stickhandliing Pucks, available from Sniper's Edge Hockey, printout available online on Mar. 4, 2015, at http://www.snipersedgehockey.com/collections/balls-pucks, 4-pages, at least as early as Dec. 23, 2014.

Blazer Replacement Track Spikes, available at http://www.eastbay.com, printout available online on Mar. 4, 2015, at http://www.eastbay.com/Cross-Country/_-_/N-1hi/keyword-replacement+track+spikes?brand=Blazer&cm_REF=Cross+Country, 4-pages, at least as early as Jul. 7, 2008.

Sof Sole Steel Pyramid Track Cleats, available from Amazon.com, printout available online on Mar. 4, 2015, at http://www.amazon.com/gp/product/B005FIX5RW/ref=pd_lpo_sbs_dp_ss_2?pf_rd_p=1944687562&pf_rd_s=lpo-top-stripe-1&pf_rd_t=201&pf_rd_i=B008B51OCO&pf_rd_m=ATVPDKIKX0DER&pf_rd_r=1YA1XF91GHN4WVE9ZS3P, 3-pages, at least as early as May 3, 2012.

* cited by examiner

© Sureshot Hockey, LLC

© Sureshot Hockey, LLC

© Sureshot Hockey, LLC

© Sureshot Hockey, LLC

© Sureshot Hockey, LLC

© Sureshot Hockey, LLC

© Sureshot Hockey, LLC

© Sureshot Hockey, LLC

© Sureshot Hockey, LLC

© Sureshot Hockey, LLC

PRACTICE HOCKEY GOALTENDERS

CROSS-REFERENCE TO RELATED APPLICATION

This application contains subject matter which is related to the subject matter of commonly owned and co-filed U.S. Design patent application Ser. No. 29/520,573, entitled "Practice Hockey Goaltender," by McMahon, Jr., which is hereby incorporated herein by reference in its entirety.

COPYRIGHT AUTHORIZATION

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE DISCLOSURE

This disclosure relates generally to training aids for playing the sport of hockey, and more specifically, to practice hockey goaltenders for practicing shooting hockey pucks into a net past a goaltender.

BACKGROUND

The prior art disclose numerous hockey training aids for practicing shots on a goaltender. One example of hockey training aids for practicing shots on a goaltender include a tarp or fabric material that attaches to the top and side poles of a hockey goal and is suspended vertically across the front of the hockey goal. Typically, the suspended flat vertical fabric material provides a two-dimensional graphic image of a goaltender in front of the goal, and has openings in the four corners and between the goaltender's legs.

U.S. Pat. No. 5,776,019, issued to Kronenberger, discloses a goalkeeping apparatus that includes a combination of a frame defining a hockey goal, a movable blocking element, and first structure for moving the blocking element in front of the frame. The first structure cooperates between the movable blocking element and frame for guiding the movable blocking element in movement relative to the frame. Alternatively, with the frame supported on a subjacent surface, the first structure cooperates between the movable blocking element and subjacent surface for guiding the movable blocking element in movement relative to the frame. The movable blocking element is constructed to simulate a "live" goalie or goaltender. That is, the movable blocking element is constructed substantially in the shape of an actual player having a full array of protective equipment and in an actual game stance. The size of the movable blocking element corresponds to the size of an average person that would play that position. The movable blocking element can be made from a flat piece of material or in three dimensions in the shape of an actual player.

There is a need for further training aids for playing the sport of hockey, and more specifically, to practice hockey goaltenders for practicing shooting hockey pucks into a net past a goaltender.

SUMMARY

In a first aspect, the present disclosure provides a free-standing practice hockey goaltender generally fixedly positionable on a playing surface in front of a hockey goal. The practice hockey goaltender includes a generally three-dimensional representation of a life-size hockey goaltender disposed in a playing position having a front side, a rear side, and at least one support extending outwardly from the rear side. The generally three-dimensional representation represents a padded left leg, a padded right leg, a hockey stick, a blocker, a catcher, a torso, and a mask. The generally three-dimensional representation includes a bottom side having a forwardly and upwardly-extending bottom surface portion disposed generally under the padded left leg and the padded right leg, and a rearwardly and upwardly-extending bottom surface portion disposed generally under the at least one support. A first plurality of spikes is releasably attachable and downwardly-dependable from the forwardly and upwardly-extending bottom surface portion under the padded left leg and the padded right leg, and a second plurality of spikes is releasably attachable and downwardly-dependable from the rearwardly and upwardly-extending bottom surface portion under the at least one support In a second aspect, the present disclosure provides a practice hockey goaltender positionable on a playing surface in front of a hockey goal. The practice hockey goaltender includes a generally rigid three-dimensional representation of a life-size hockey goaltender disposed in a playing position. The generally rigid three-dimensional representation has the appearance of being formed from a left padded leg plate-like element, a right padded leg plate-like element, a hockey stick plate-like element, a blocker plate-like element, a catcher plate-like element, a catcher plate-like element, a torso plate-like element, and a mask plate-like element. The generally rigid three-dimensional representation has a height of about 50 inches to about 60 inches, and a width of about 45 inches to about 55 inches. The left padded leg plate-like element and the right padded leg plate-like element has a thickness of about 5 inches to about 10 inches, and the torso plate-like element has a thickness of about 1 inch to about 3 inches.

In a third aspect, the present disclosure provides a practice hockey goaltender positionable on a playing surface in front of a hockey goal. The practice hockey goaltender includes a generally rigid three-dimensional representation of a life-size hockey goaltender disposed in a playing position having a front side, a rear side, and a peripherally-extending side disposed between the front side and the rear side. The front side represents a padded left leg, a padded right leg, a hockey stick, a blocker, a catcher, a torso, and a mask. The generally rigid three-dimensional representation includes a monolithic structure having an outer wall defining a hollow cavity therein.

In a fourth aspect, the present disclosure provides methods of simulating a hockey goaltender. The methods include providing a hockey goal, and providing the practice hockey goaltender as noted above disposed in front of the hockey goal.

Additional features and advantages are realized through the concepts of the present disclosure. Other embodiments and aspects of the disclosure are described in detail herein and are considered a part of the claims.

BRIEF DESCRIPTION OF THE DRAWINGS

Various aspects of the present disclosure are particularly pointed out and distinctly claimed as examples in the claims at the conclusion of the specification. The foregoing and other objects, features, and advantages of the disclosure are apparent from the following detailed description taken in conjunction with the accompanying drawings in which:

DETAILED DESCRIPTION

Figure 1:
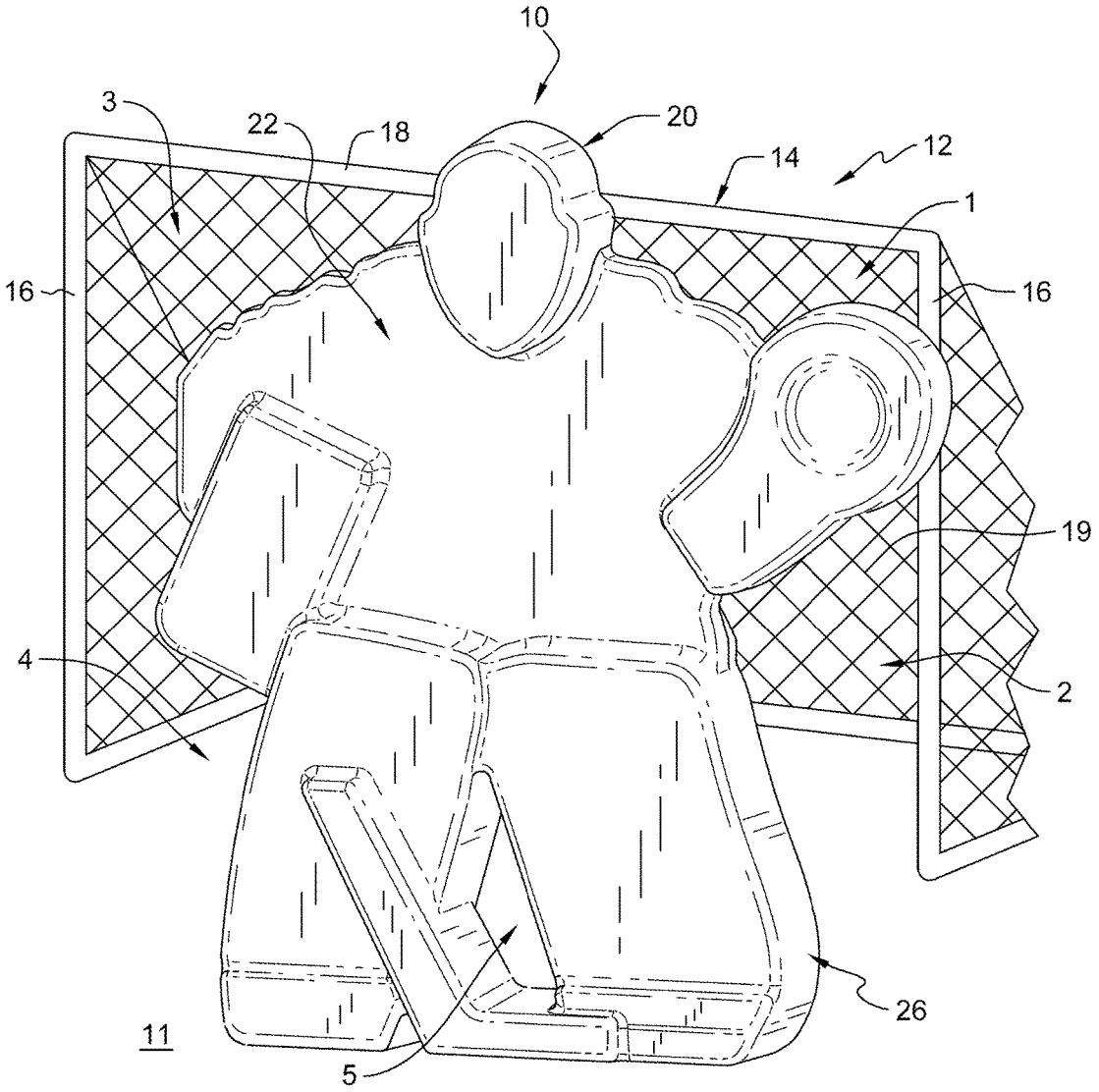
FIG. 1 is a front perspective view of a practice hockey goaltender in accordance with aspects of the present disclosure disposed in front of a hockey goal.

FIG. 1 illustrates an embodiment of a practice hockey goaltender 10 in accordance with aspects of the present disclosure positionable in front of a hockey goal 12. For example, practice hockey goaltender 10 may be non-flat, freestanding, and generally fixedly positionable on a playing surface 11 such as on an ice rink, a driveway, or a road in front of hockey goal 12. Hockey goal 12 may be a conventional goal having a frame 14 having standard dimensions, including laterally spaced upright bars 16 and horizontal cross bar 18 to which a net 19 is attached. Practice hockey goaltender 10 is positionable in front of goal 12 to provide an obstruction to the goal opening to simulate a live goalie or goaltender. The representation may be the size of an average goaltender disposed in a playing position, and positionable in front of goal 12. For example, as illustrated in FIG. 1, goal 12 is a regulation hockey goal with an opening of the goal being 72 inches wide by 48 inches tall, and a footprint of the goal being 44 inches deep. Aspects of practice hockey goaltender 10 may provide an impact resistant, life-size, freestanding, stable, fixed form, and/or generally realistically looking practice hockey goaltender that is readily movable, positionable, and/or mobile for indoor or outdoor use. Further aspects may include no movable parts, weatherproof, and temperature resistant.

Practice hockey goaltender 10 may include a generally rigid three-dimensional representation 20 of a life-size hockey goaltender disposed in a playing position such as in a typical position that the goaltender would occupy during a hockey game. In this illustrated embodiment, generally rigid three-dimensional representation 20 may include a front side 22, a rear side 24 (shown in FIG. 3), and a peripherally-extending side 26 disposed between the front side and the rear side. For example, peripherally-extending side 26 may be disposed generally normal the front and rear surfaces. The generally rigid three-dimensional representation may be a fixed form having no moving parts such as the arms, legs, hockey stick, etc.

Figure 2:
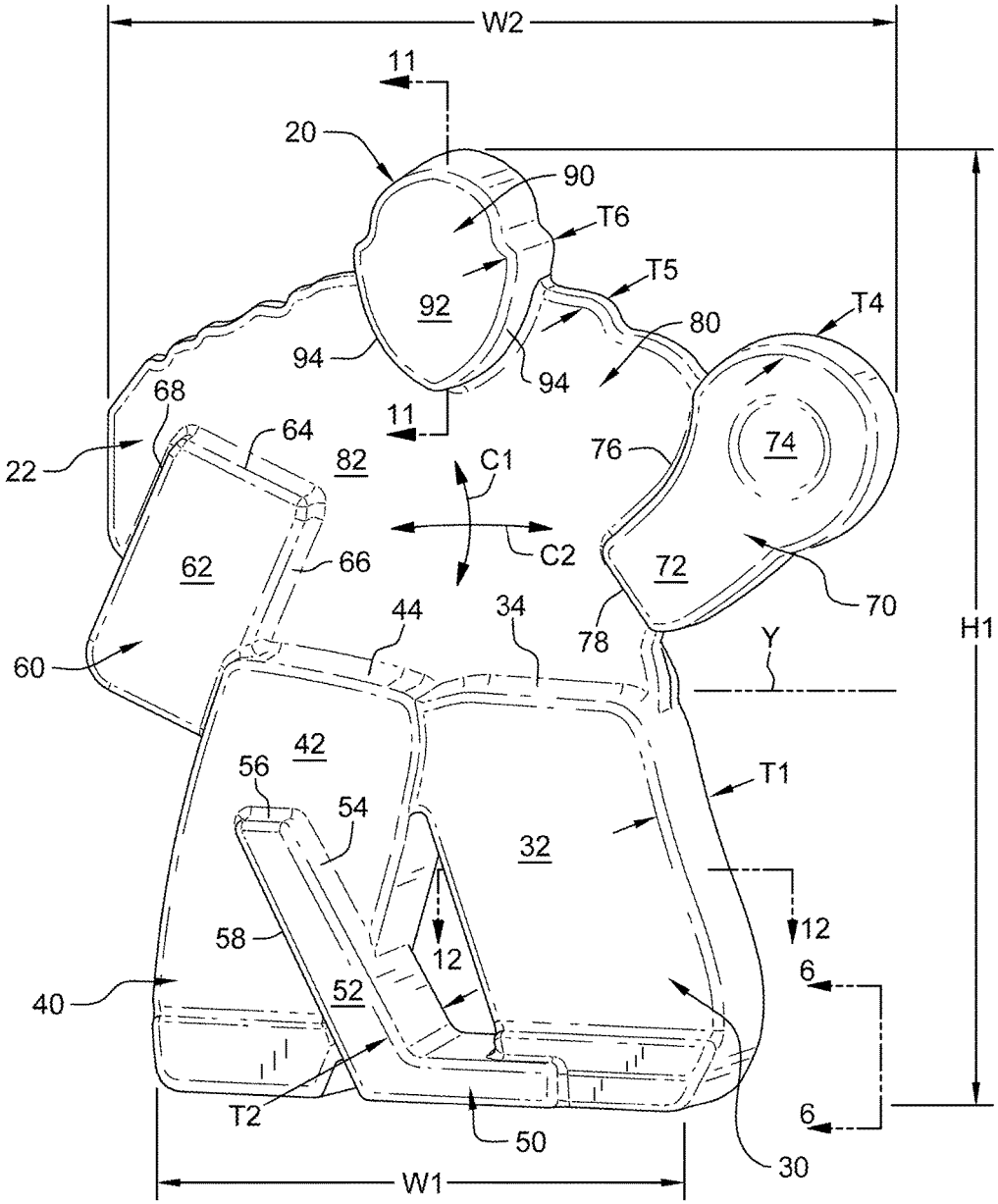
FIG. 2 is another front perspective view of the practice hockey goaltender of FIG. 1.
Figure 3:
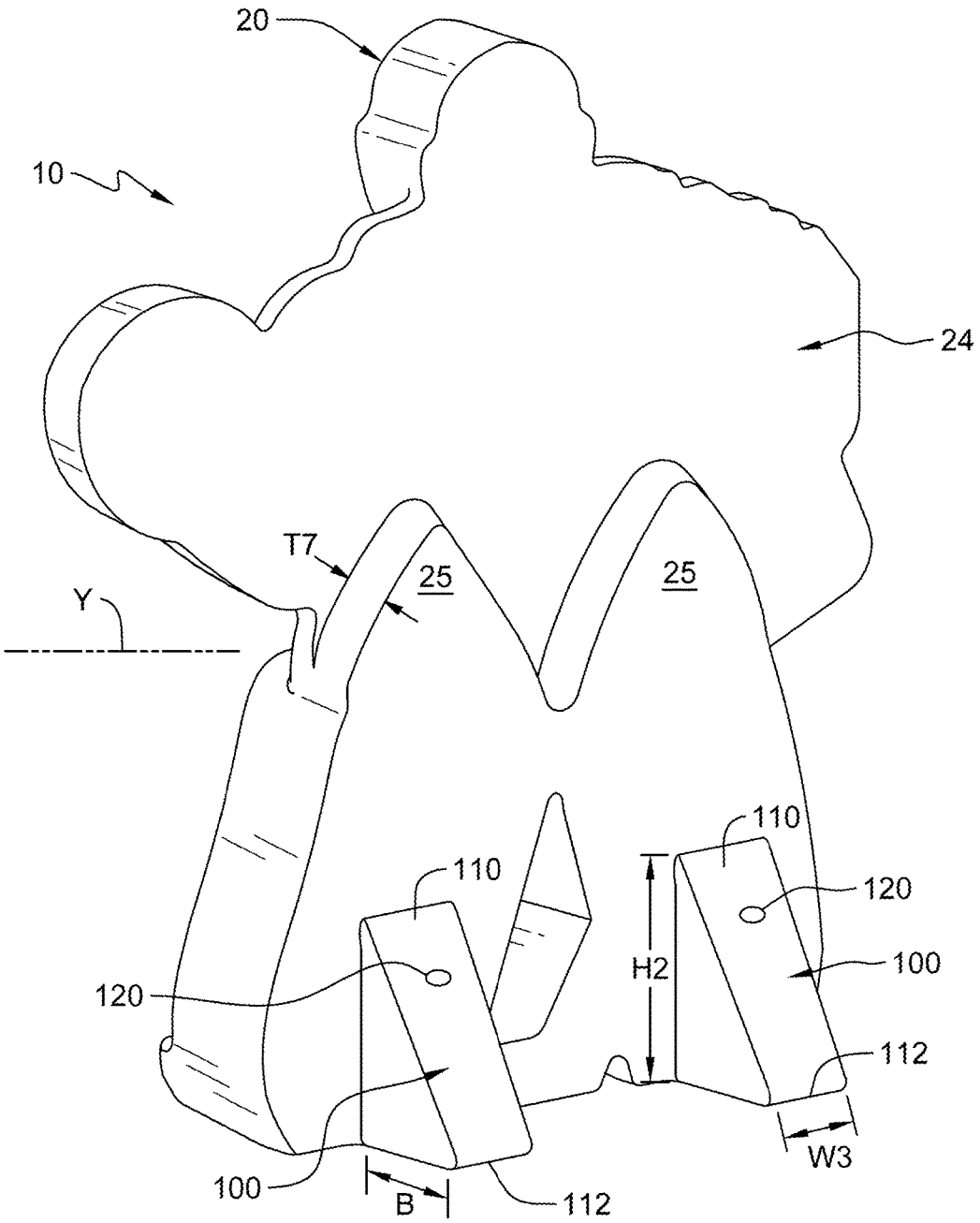
FIG. 3 is a rear perspective view of the practice hockey goaltender of FIG. 1.
Figure 4:
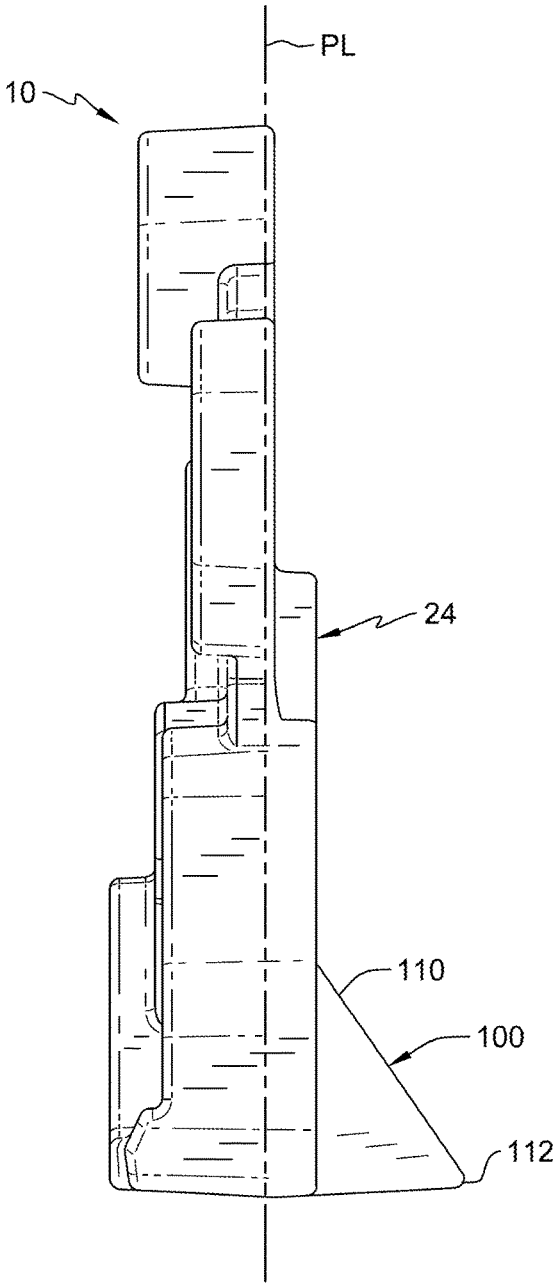
FIG. 4 is a left side elevational view of the practice hockey goaltender of FIG. 1.
Figure 5:
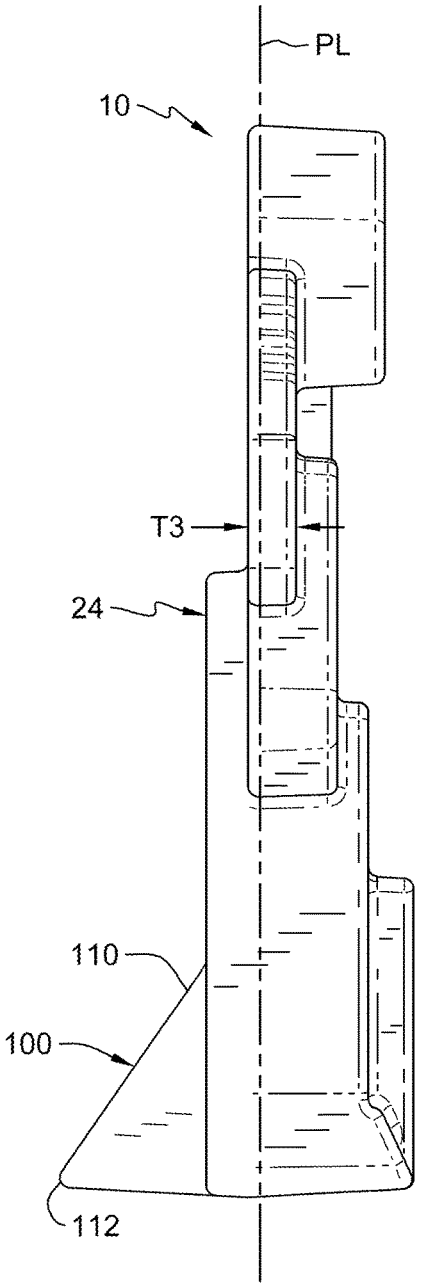
FIG. 5 is a right side elevational view of the practice hockey goaltender of FIG. 1.

With reference to FIG. 2, front side 22 of generally rigid three-dimensional representation 20 may include a life-size three-dimensional representation of a padded left leg 30, a life-size three-dimensional representation of a padded right leg 40, a life-size three-dimensional representation of a hockey stick 50, a life-size three-dimensional representation of a blocker 60, a life-size three-dimensional representation of a catcher 70, a life-size three-dimensional representation of a torso 80, and a life-size three-dimensional representation of a mask 90. As shown in FIGS. 3-5, practice hockey goaltender 10 may include a plurality of spaced-apart supports 100 that extend outwardly from rear side 24, e.g., form proximal portion 110 to a distal end 112.

With reference again to FIG. 2, torso 80 may include a generally vertically-extending concave surface 82 as illustrated by curved arrows C1 and C2. For example, concave surface 82 may be slightly curved generally having a center portion disposed about ¼ inch to about ¾ inch, or about ½ inch, inwardly compared to the lateral side portions of the torso. Padded left leg 30 may have a generally flat vertically-extending front surface 32, padded right leg 40 may have a generally flat vertically-extending front surface 42, hockey stick 50 may have a generally flat vertically-extending front surface 52, blocker 60 may have a generally flat vertically-extending front surface 62, catcher 70 may have a generally flat vertically-extending front surface 72 and a generally flat vertically-extending recessed portion 74, and a mask 90 may have a generally flat vertically-extending front surface 92. Recessed portion 74 may be about ¾ inch deep compared to front surface 72 of catcher 70. It will be appreciated that the front facing surfaces of the various components may have vertical, angled, convex, concave, curved, or other suitably configured surfaces. The various components may be more or less realistic than the practice hockey goaltender illustrated in the drawings. At least some of the padded legs, the chest, the mask, the blocker, the catcher, and the hockey stick may have different thicknesses from front to back, and/or at least some of the front surfaces may be offset from each other. In other embodiments, the padded legs, the chest, the mask, the blocker, the catcher, and the hockey stick may have different thicknesses from front to back, and/or have front surfaces that are offset from each other.

Three-dimensional representation 20 may have the appearance of being formed or assembled from a plurality of generally plate-like, slab-like, block-like, or cuboid-like elements. For example, representation 20 may have the appearance of being formed from a left padded leg plate-like element 30, a right padded leg plate-like element 40, a hockey stick plate-like element 50, a blocker plate-like element 60, a catcher plate-like element 70, a torso plate-like element 80, a mask plate-like element 90, and triangular plate-like support elements 100 (FIG. 3).

For example, three-dimensional representation 20 may include catcher plate-like element 70 placed in a defensive position normally occupied by the goaltender's left arm, and blocker plate-like element 60 positioned in its normal defensive position. For example, blocker plate-like element 60 may represents the goaltender's right arm normally used by the goaltender in holding hockey stick plate-like element 50. Mask plate-like element 90 may be sized proximate to the same size as a goaltender's head enclosed in a mask or helmet. The bottom of the representation may include the bottoms of left padded leg plate-like element 30, right padded leg plate-like element 40, and hockey stick plate-like element 50 extending across a lower edge of representation 20 for deflecting pucks which are shot or slid into representation 20 over, for example, the ice.

The generally vertical forward facing surface 92 of mask plate-like element 90 may be spaced about 4 inches from forward facing surface 82 of torso plate-like element 80. The left padded leg plate-like element 30 may define a generally horizontal ledge 34 extending between front surface 32 of left padded leg plate-like element 30 and front surface 82 of torso plate-like element 80, and right padded leg plate-like element 40 may define a generally horizontal ledge 44 between front surface 42 of left padded leg plate-like element 40 and front surface 82 of torso plate-like element 80. The ledges may have a depth of about 3 inches. Blocker plate-like element 60 may include surfaces 64, 66, and 68 disposed generally normal to vertically-extending flat surface 62 and to surface 82 of torso 80. Catcher plate-like element 70 may include surfaces 76 and 78 disposed generally normal to vertically-extending flat surface 72 of catcher plate-like element 70 and to surface 82 of torso 80. Mask plate-like element 90 may include lower surfaces 94 or bottom of the mask disposed normal to vertically-extending flat surface 92 and to surface 82 of torso 80. Hockey stick plate-like element 50 may include surfaces 54, 56, and 58 disposed generally normal to vertically-extending flat surface 42 of right padded leg plate-like element 40. A puck that hits ledges 34 or 44, surfaces 54, 56, 58, 64, 66, 68, 76, 78, or 94, or peripheral edge 26, for example directly or indirectly bouncing off another surface such as the torso, may result in the puck being deflected in a realistic fashion. For example, a puck that hits surface 94 of mask 90 may be deflected downwardly.

Figure 6:
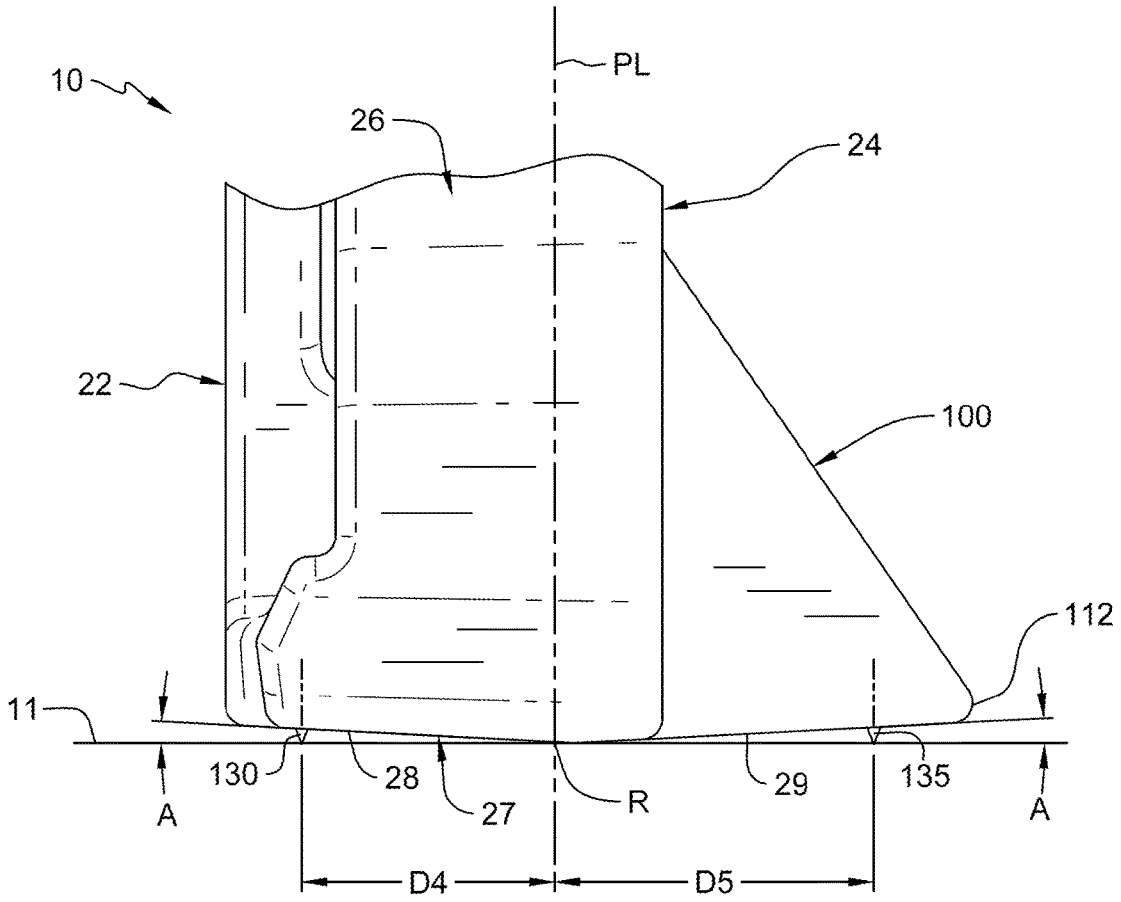
FIG. 6 is an enlarged view of the lower portion of the practice hockey goaltender taken in the direction of arrows 6-6 in FIG. 2.

As shown in FIG. 6, peripherally-extending side 26 may include a bottom surface 27 having a forwardly and upwardly-extending bottom surface portion 28 disposed generally under the front portion of the padded left leg and the padded right leg, and a rearwardly and upwardly-extending bottom surface portion 29 disposed generally under the rear portion of the padded left leg, the padded right leg, and supports 100. Forwardly and upwardly-extending bottom surface portion 28 and rearwardly and upwardly-extending bottom surface portion 29 may extending (into the page of FIG. 6) generally linearly across at least portion of a width W1 (FIG. 2) of the lower portion of the generally rigid three-dimensional representation when the practice hockey goaltender is positioned generally vertically on playing surface 11.

Forwardly and upwardly-extending bottom surface portion 28 and rearwardly and upwardly-extending bottom surface portion 29 may meet at and define a lowermost downwardly depending ridge R that may be an elongated crest or series of crests extending across at least portion or generally all of the width of the bottom surface of the generally rigid three-dimensional representation. Ridge R may include a point, edge, convex surface area, or other configuration. In some embodiments, forwardly and upwardly-extending bottom surface portion 28 and rearwardly and upwardly-extending bottom surface portion 29 may at and define an elongated cutout or indentation forming two ridges.

Forwardly and upwardly-extending bottom surface portion 28 and rearwardly and upwardly-extending bottom surface portion 29 may be substantially non-horizontally-extending surfaces which face playing surface 11 when the practice hockey goaltender is positioned generally vertically on the playing surface. For example, forwardly and upwardly-extending bottom surface portion 28 and rearwardly and upwardly-extending bottom surface portion 29 may generally be positionable on an angle A of about 2 degrees to about 4 degrees, or about 3 degrees relative to the playing surface. Forwardly and upwardly-extending bottom surface portion 28 and rearwardly and upwardly-extending bottom surface portion 29 may be planar surfaces, convex surfaces, combinations thereof, or other suitable surfaces operable to provide an apex, ridge, crest, or other lowermost portion disposed between the front of the practice hockey goaltender and distal end 112.

Figure 7:
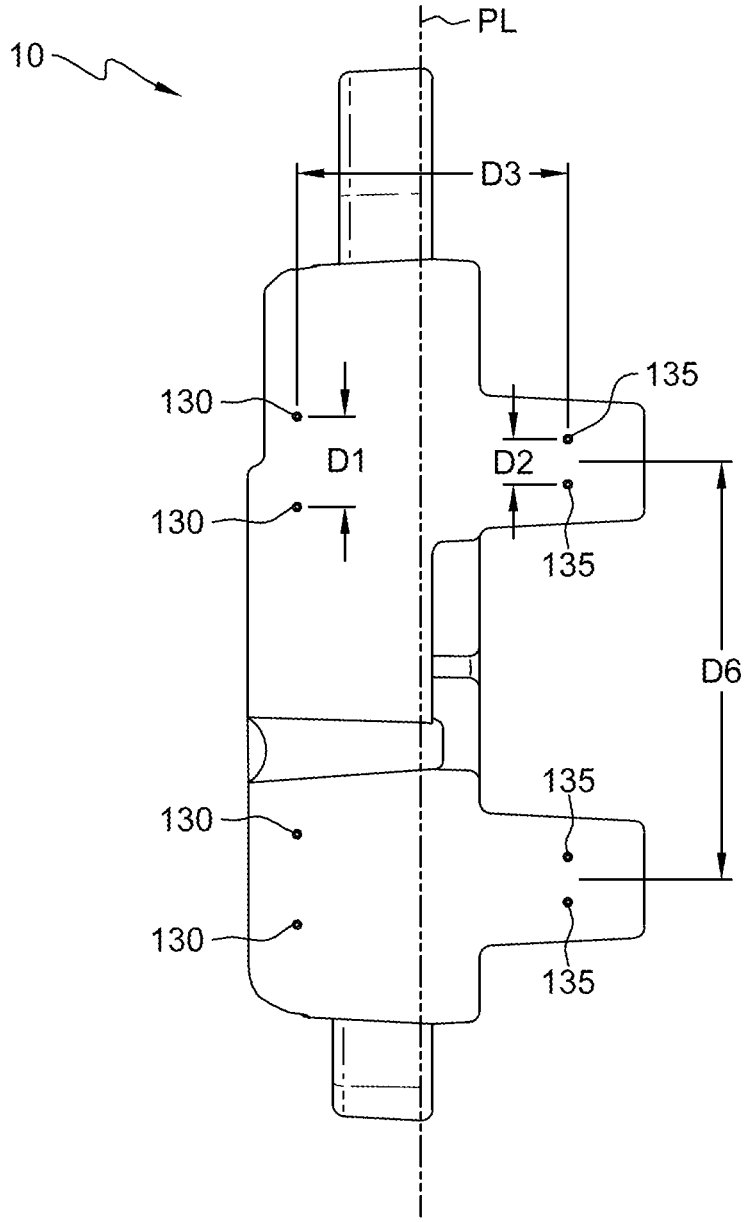
FIG. 7 is an enlarged bottom view of the practice hockey goaltender of FIG. 1.

FIG. 7 illustrates the bottom side of practice hockey goaltender 10 which may include a first plurality of spikes 130 extending generally outwardly from bottom surface 27 adjacent the front of three-dimensional representation 20, and a second plurality of spikes 135 extending generally outwardly from the bottom surface of the plurality of spaced-apart supports. For example, two spikes 135 may be disposed on each support, and 4 spikes 130 may be disposed generally along the width and adjacent the front of three-dimensional representation 20. Each pair of spikes 130 may be spaced apart a distance D1 about 5 inches, each pair of spikes 135 may be spaced apart a distance D2 about 1.5 inches, and spikes 130 and 135 may be spaced a distance D3 of about 13 inches from each other. With reference again to FIG. 6, spikes 130 may be spaced a distance D4 of about 5 inches from a mold parting line PL and the lowermost portion of the bottom side, and spikes 135 may be spaced a distance D5 of about 8 inches from mold parting line PL and the lowermost portion of the bottom side. As shown in FIG. 7, the supports and the spikes may be centered and spaced apart a distance D6 of about 18 inches.

With reference again to FIG. 6, the length of the spikes disposed in the back and extending from the supports may be longer than the length of the spikes disposed in the front and extending from the padded left and right legs. The spikes and the ridge may form contact portions for engaging the playing surface. For example, the front spikes, the ridge, and the rear spikes may form generally three spaced apart lines of contact extending across the width of the bottom of the practice hockey goaltender. Spikes 130 may have a length of about ¼ inch extending from bottom surface 27, and spikes 135 may have a length of about ⅜ inch extending from bottom surface 127. Spikes 130 and 135 may be disposed on a non-vertical angle relative to the horizontal playing surface, or normal to the bottom surfaces. Spikes 130 generally prevent sideways or rotating motion of practice hockey goaltender 10 on an ice rink. Spikes 135 generally prevent motion of practice hockey goaltender 10 backwards on an ice rink. The spikes may be sized so that when practice hockey goaltender 10 is initially placed on an ice rink, the distal ends of the spikes may just dig into the ice slightly so that practice hockey goaltender 10 dies not easily slide. Shorter length spikes may allow practice hockey goaltender 10 to easily slide on ridge R.

Figure 8:
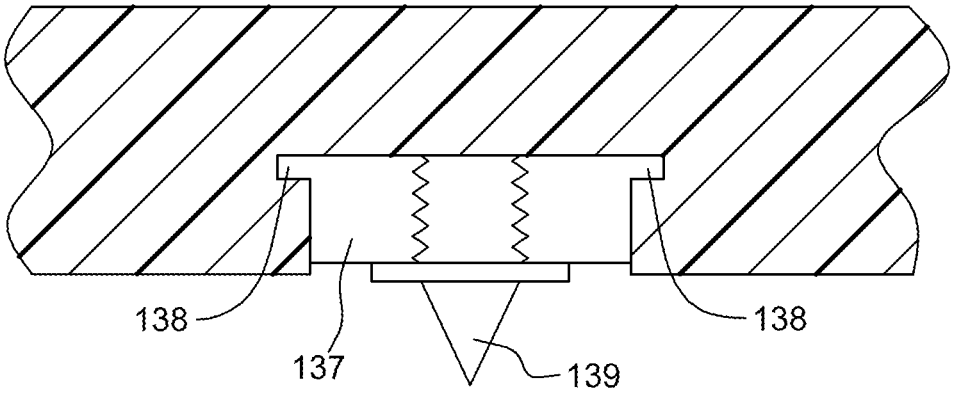
FIG. 8 is a cross-sectional view through one of the spikes in the practice hockey goaltender of FIG. 6.

The first plurality of spikes and the second plurality of spikes may be releasably attachable to the three-dimensional representation. The releasably attachable spikes allow interchangeability with different length spikes, e.g., the selection of which may depend on the type of playing surface the practice hockey goaltender is positioned on. For example, as shown in FIG. 8, a plurality of internally threaded nuts 137 having one or more outwardly extending portions 138 may be operably attached or molded into the bottom side portion of peripherally extending side, and/or into the bottom side portion of the support. The spikes may include an externally threaded post that is releasably attachable to the nut. Suitable spikes 130 include ¼ inch needle spikes available from Blazer Athletic Equipment of Columbus, Nebr., and suitable spikes 135 include ⅜ inch needle spikes available from Blazer Athletic Equipment of Columbus, Nebr.

Figure 9:
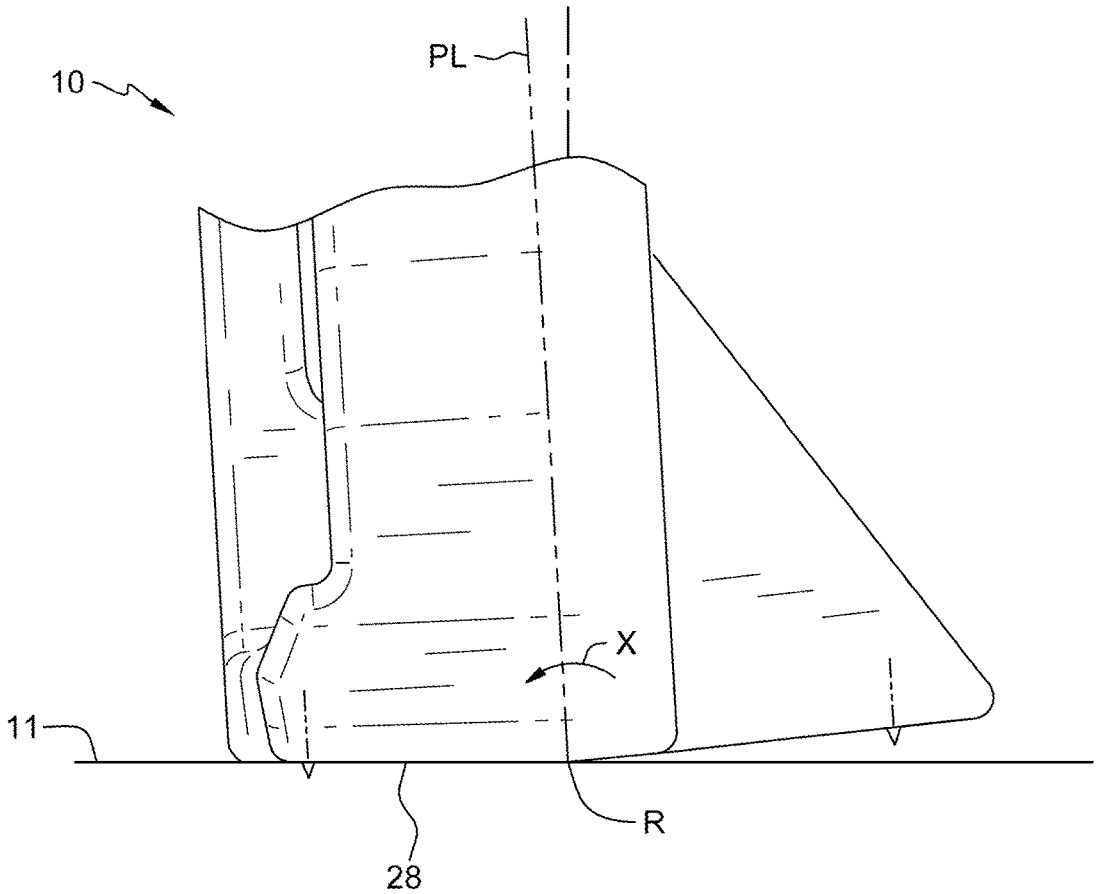
FIG. 9 is an enlarged view of the lower portion of the practice hockey goaltender similar to FIG. 6 during use of the practice hockey goaltender on an ice playing surface such as an ice rink.
Figure 10:
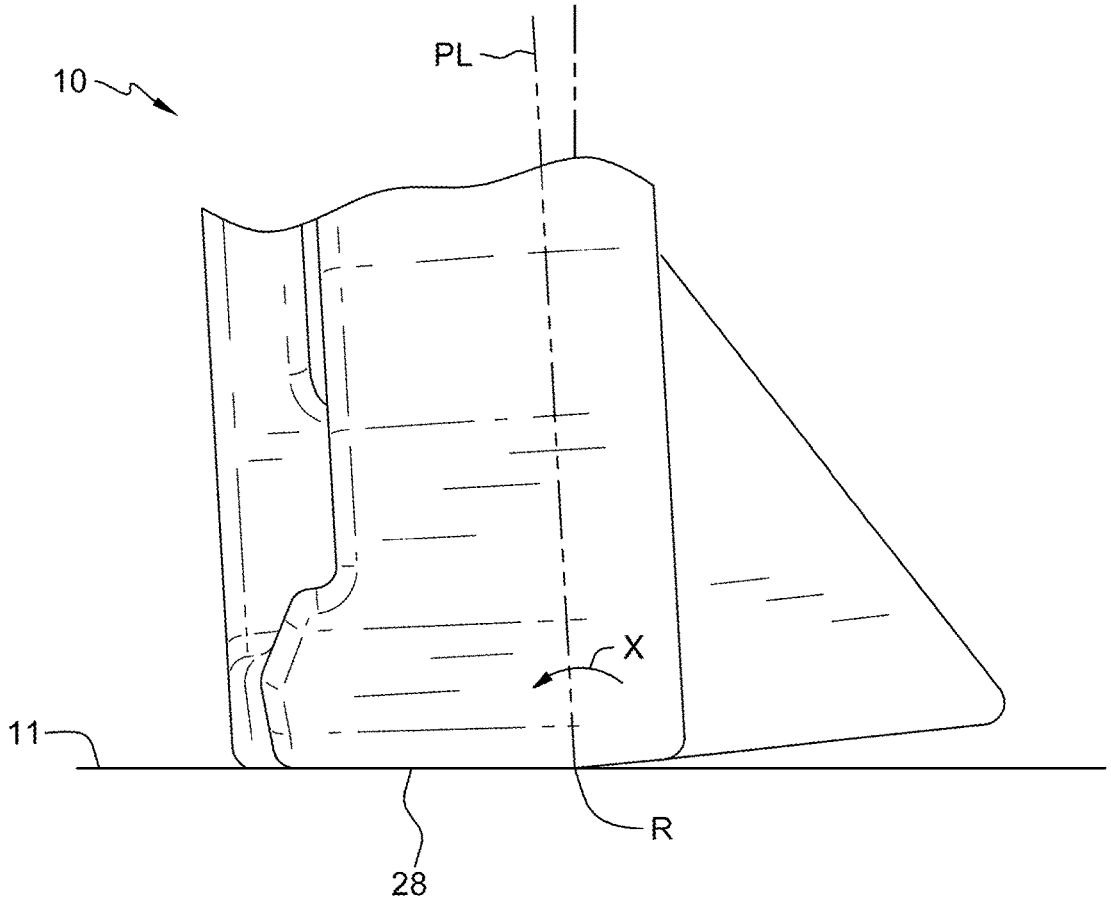
FIG. 10 is a view of the lower portion of the practice hockey goaltender similar to FIG. 6 in which the spikes are removed and the practice hockey goaltender is disposed on a paved playing surface such as a road or a driveway.

With reference to FIGS. 9 and 10, practice hockey goaltender 10 may include a weight distribution toward the front so that when practice hockey goaltender 10 is disposed and used on a playing surface, practice hockey goaltender 10 is generally supported upright and resting generally on forwardly and upwardly-extending bottom surface portion 28. For example as shown in FIG. 9, practice hockey goaltender 10 may have a weight distribution toward the front so that when the practice hockey goaltender with the plurality of spikes is used (after stopping one or more hockey shots) on an ice playing surface, practice hockey goaltender 10 pivots or rotates forward about ridge R in the direction of arrow X so that the front spikes become embedded in the ice and practice hockey goaltender 10 is generally supported upright and resting generally on forwardly and upwardly-extending bottom surface portion 28. It has been found that practice hockey goaltender disposed on ice and having spikes disposed in the front but not in the supports, results in the practice hockey goaltender turning, moving, or sliding, side to side when impacted by hockey pucks. Spikes only disposed in the supports, results in the practice hockey goaltender rotating back and forth and moving forward toward the shooter when impacted squarely by hockey pucks, and when impacted on the side resulting in the practice hockey goaltender turning or rotating. Spikes disposed on both the front and the back results in maintaining the position of the practice hockey goaltender in a freestanding, and generally fixed upright position (e.g., not rotating or moving from side to side) on the playing surface when impacted by a hockey puck or simultaneously by two hockey pucks shot by two players at the same time.

As shown in FIG. 10, practice hockey goaltender 10 may have a weight distribution toward the front so that when the practice hockey goaltender without the plurality of spikes is placed on and used on a paved playing surface, practice hockey goaltender 10 is generally supported upright and resting generally on forwardly and upwardly-extending bottom surface portion 28. The combination of forwardly and upwardly-extending bottom surface portion 28 and ridge R may provide suitable resistance or friction and/or allow practice hockey goaltender 10 to pivot or rock about ridge R so that practice hockey goaltender 10 remains in a generally fixed or stationary position in front of a hockey goal when impacted by hockey pucks.

Whether on a road or driveway without spikes, or on ice with spikes, the distribution of weight of the practice hockey goaltender result in the weight being supported by and across forward and upwardly-extending bottom surface portion 28. At the same time, the vertical surfaces of the various components of the practice hockey goaltender may be disposed on a slight angle forward. The combination of the weight distribution on forward and upwardly-extending bottom surface portion 28 and slightly angled front surfaces results in the practice hockey goaltender remaining in a generally fixed upright and generally fixed position when a player shoots and impacts the practice hockey goaltender with hockey pucks. In other embodiments, practice hockey goaltenders in accordance with aspects of the present disclosure may include a weight distribution toward the back that results in the practice hockey goaltenders being supported by and across a rearward and upwardly-extending bottom surface portion. In this configuration, the vertical surfaces of the various components of the practice hockey goaltender may be disposed on a slight angle backward. The combination of the weight distribution on rearward and upwardly-extending bottom surface portion and slightly angled front surfaces may result in the practice hockey goaltender remaining in a generally fixed upright and generally fixed position when a player shoots and impacts the practice hockey goaltender with hockey pucks.

Figure 11:
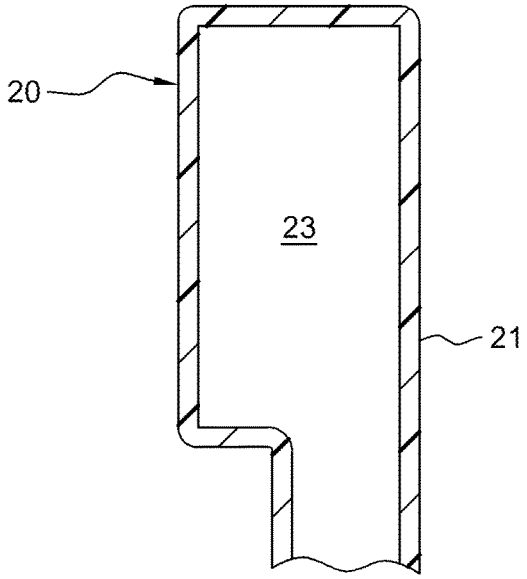
FIG. 11 is an enlarged cross-sectional view taken along line 11-11 in FIG. 2.
Figure 12:
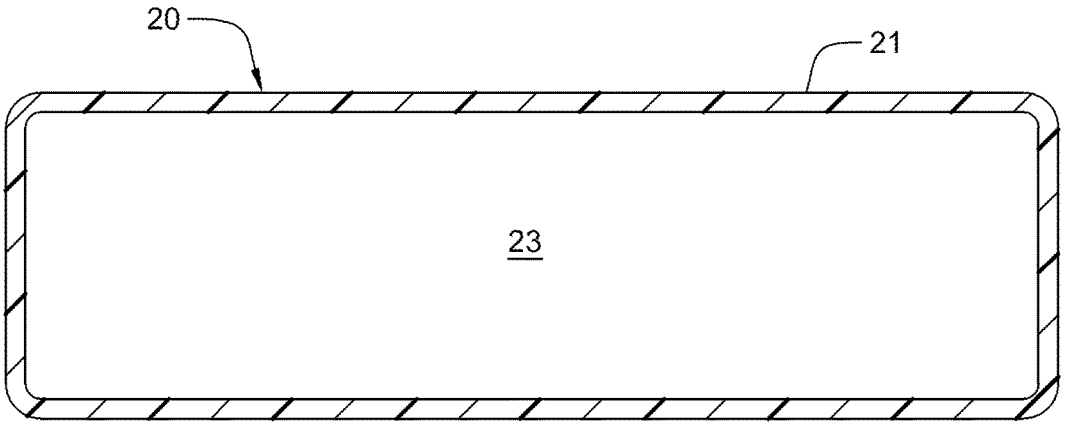
FIG. 12 is an enlarged cross-sectional view taken along line 12-12 in FIG. 2.

With reference to FIGS. 11 and 12, generally rigid three-dimensional representation 20 may be a unitary, integrally formed, one-piece, or monolithic impact resistant structure having an outer shell or outer wall 21 defining a hollow inner cavity 23 therein. The outer wall may generally have a wall thickness of between about 2 millimeters to about 10 millimeters, between about 3 millimeters to about 7 millimeters, between about 4 millimeters to about 6 millimeters, between about 3 millimeters and 5 millimeters, about 4 millimeters, about 5 millimeters, about 6 millimeters, or other suitable wall thickness. The generally rigid three-dimensional representation may have a generally uniform wall thickness throughout the generally rigid three-dimensional representation or have portions that have different wall thicknesses. The cavity formed therein may be generally empty or otherwise generally contain air. The surrounding outer wall may be formed by rotational molding, a manufacturing process operable to create a low stress, hollow part. Rotational molding may include a heated hollow mold which is filled with a charge or shot weight of material. The mold and material is then slowly rotated (usually around two perpendicular axes) causing the softened material to disperse and stick to the walls of the mold. Rotating the mold during the heating phase maintains an even thickness throughout the part and avoids sagging or deformation also during the cooling phase. It will be appreciated that other manufacturing processes may be employed for forming the generally rigid three-dimensional representation. For example, rotocasting or rotacasting may be employed which uses self-curing resins in rotated unheated molds. Mold parting line PL (FIGS. 4 and 5) may extend generally along the peripheral edge of the practice hockey goaltender. The outer wall may be formed from a suitable plastic or polymeric material. For example, the outer wall may be formed from a polyethylene material. The outer surface of the may have a sand blasted finish formed by a sand blasted finish of the mold.

With reference again to FIG. 2, three dimensional representation 20 may have a height H1 of about 50 inches to about 60 inches such as about 54 inches, a width W3 of about 45 inches to about 55 inches such as about 48 inches at its widest point, and width W1 along the bottom of about 25 inches to about 35 inches such as about 30 inches. Padded left leg 30 and padded right leg may have a depth or thickness T1 of about 5 inches to about 10 inches such as about 7½ inches, hockey stick 50 may have a depth or thickness T2 of about 10 inches and the distance from the face of the padded left leg to the surface of the hockey stick may be about 2 inches, blocker 60 may have a depth or thickness T3 (FIG. 5) of about 3 inches to about 5 inches such as about 4 inches, catcher 70 may have a depth or thickness T4 of about 3 inches to about 5 inches such as about 4 inches, torso 80 may have a depth or thickness T5 of about 1 inch to about 3 inches such as about 2 inches or about 2¼ inches, and mask 90 may have a depth or thickness T6 of about 5 inches to about 8 inches such as about 6½ inches. The face of the blocker may be about 2 inched in front of the front of the torso. The face of the catcher may be about 1½ inches in front of the face of the torso. As shown in FIG. 3, supports 100 may include a base B extending about 7 inches from rear side 24. The support may have a height H2 of about 11 inches and a width W3 of about 5½ inches. Rear side 24 may include inverted U-shaped portions 25 having a thickness T7 of about 2 inches that extend behind the torso to give added rigidity to the three dimensional representation. For example, the inverted U-shaped portions 25 aid in inhibiting the torso from being bent along the top of the padded legs. The various sizes may be greater or less that the dimensions described above. The three dimensional representation when viewed by a shooter from the front and also from the side may provide a realistic configuration of a real goaltender.

With reference to FIGS. 2 and 3, at least about 50-percent, at least 60-percent, or at least 70 percent of the weight of the practice hockey goaltender may be disposed below the waist, e.g., below line Y, of the practice hockey goaltender. For example, the thinner torso compared to the thicker padded legs provides for a lower center of gravity which aids in the practice hockey goaltender remaining in an upright orientation during use. The practice hockey goaltender may be fabricated from a polyethylene material and weigh about 40 pounds to about 55 pounds such as about 47 pounds. Impact and pressure testing of the hollow practice hockey goaltender having spikes positioned on an ice rink and impacted with a plurality of pucks being shot simultaneously at speeds of up to about 105 miles per hour resulted in the pucks being stopped or deflected and the practice hockey goaltender remaining essentially stationary in front of the goal. The practice hockey goaltender is usable at temperatures of minus 30 degrees Fahrenheit. A plurality of holes 120 (FIG. 3) in support 100 (FIG. 3) may be disposed on the outer wall to allow for filling the hollow inner cavity of three dimensional representation at least partially with a ballast material such as sand, water, or other suitable material. The plurality of holes allow for filling the hollow inner cavity of three dimensional representation with a foam or other suitable material that may increase the rigidity or impact strength of the three dimensional representation.

Figure 13:
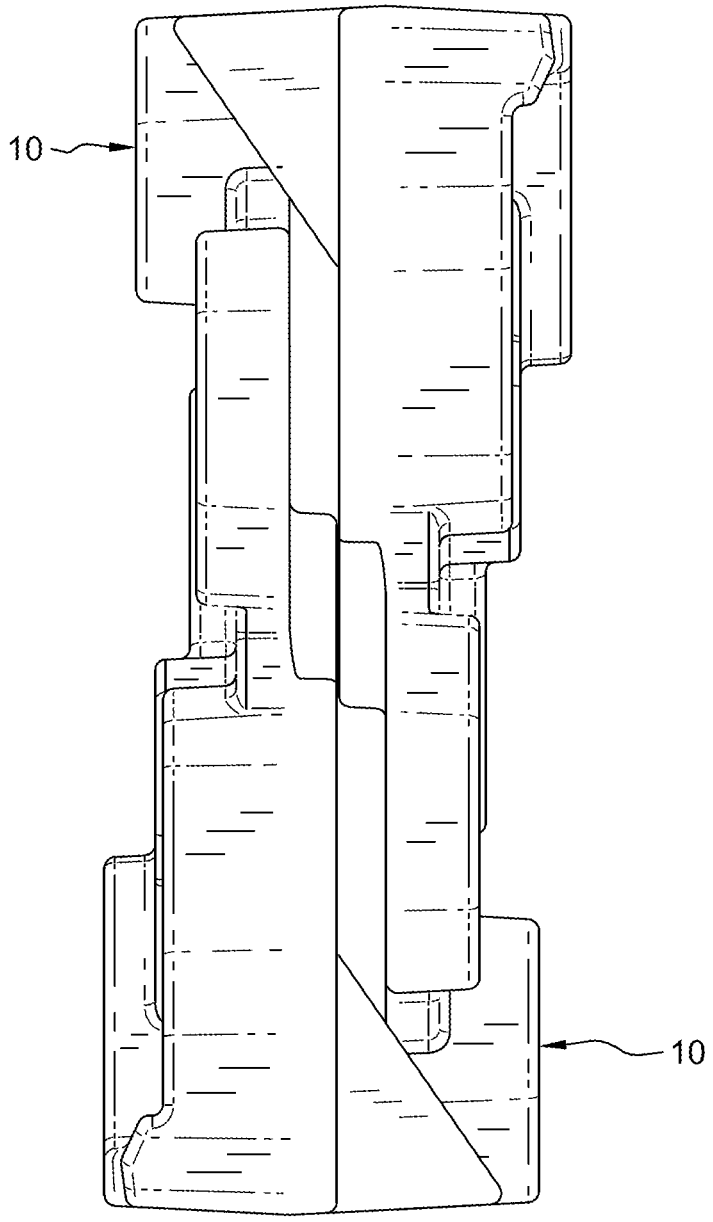
FIG. 13 is a side elevational view of a plurality of practice hockey goaltenders of FIG. 1 nested together for shipping or storage.

The practice hockey goaltender may be relatively easy to move, transport, and store. The configuration of the practice hockey goaltender allows a plurality of practice hockey goaltender to be nested together for compact shipment or storage. For example, as shown in FIG. 13, a pair of practice hockey goaltender may be nested together with the rear sides disposed side-by-side and with one disposed in an upright orientation and the other disposed in an inverted orientation so that the mask of one practice hockey goaltender is disposed between the supports of the other practice hockey goaltender. The combined depth of the two stacked practice hockey goaltender may be about 18 inches to about 20 inches.

Being formed from a polymeric material, the practice hockey goaltender is not subject to rust. The practice hockey goaltender may be formed in different colors such as entirely in red or yellow, or may be formed having a plurality of colors such as having a tie-dyed look. The goaltender mask may be life-like in size thereby providing a more accurate visual reference for the player. The shoulders may also be of correct size with visual portions. The rounded edges may provide for strength and durability and provide no sharp edges and may result in the practice hockey goaltender being more life-like and more realistic. The rounded edges may have a radius of about ½ inch to about 1 inch, about ½ inch, about ¾ inch, about 1 inch, or other suitable radii. Alternatively, the practice hockey goaltender may be provided with chamfered edges. The blocker may provide three dimensions offering visual reference to the player, proper positioning, more realistic net covering, and different rebound options or actions such as due to the sides of the blocker. The glove or catcher may provide an accurate and proper area to protect the net, and may provide three dimensional rebound options or actions with rounded edges and the recess center. The leg pads may provide realistic three dimensional rebound options or actions with rounded edges. An appropriable space may be provided for a 5 hole, e.g., space between legs of the goaltender. The hockey stick may prove for realistic three dimensional rebound options or actions. The practice hockey goaltender may include a taller back support or torso which provides a realistic vision of thickness from a side view. Also, a thinner and curved back support or torso may provide a lower center of gravity for increased stability.

With reference again to FIG. 1, when the practice hockey goaltender is positioned adjacent to the goal, there may be generally five open areas or holes for a player taking shot. For example, a first open area 1 may include a high catcher or glove side area defined by the goaltender's arm and catcher on the bottom, mask on the inside, and the post and top of the goal on the outside. A second open area 2 may include a low catcher or glove side defined by the goaltender's arm and catcher on the top, the left padded leg, the ice on the bottom, and the outside post of the goal. A third open area 3 may include a high stick side defined by the goal post, top of the goal, and the goaltender's arm and blocker. While a top half of the goaltender's stick may be held in this area, it is not commonly used for stopping the puck. As shown in FIG. 1, the top of the torso may not include the upper portion of the hockey stick. A fourth open area 4 may include a low stick side area defined by the blocker and arm, the right padded leg, the ice, and the outer post of the goal. A fifth open area 5 may be defined between the goaltender's leg pads and hockey stick. Below this area may be protected by the blade of the stick. In other embodiments of the practice hockey goaltender, additional holes may be provided. For example, the practice hockey goaltender may be provided with a sixth open area and a seventh open area under either armpit of the goaltender. For example, the torso portions may be provided with opening areas extending through the torso portions. It will be appreciated that the practice hockey goaltender may be configured in other configurations, for example, a crouched playing position, a standing playing position, a configuration during a butterfly-style save, or other configurations. The life-size practice hockey goaltender may be sized for practice by younger players or adults.

Figure 14:
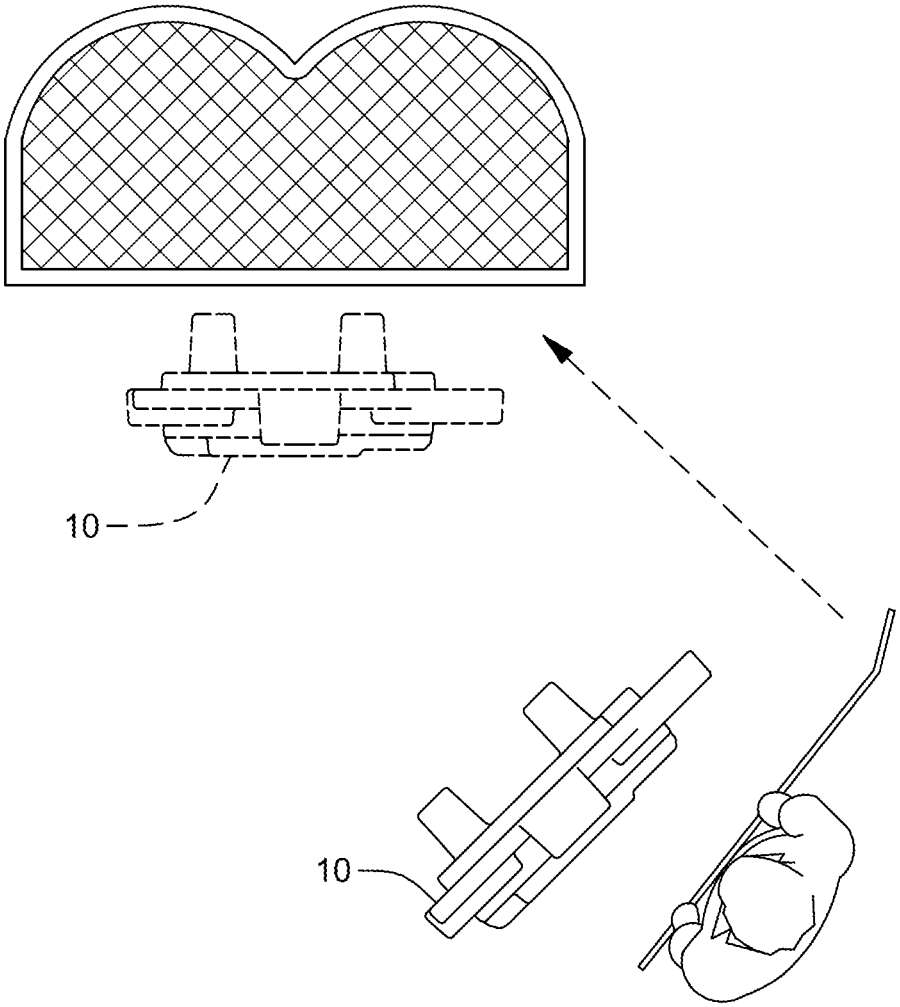
FIG. 14 is a diagrammatic illustration of the practice hockey goaltender of FIG. 1 disposed in two positions in front of a goal for practicing shooting.

FIG. 14 illustrates a diagram of a number of typical locations for positioning or moving practice hockey goaltender 10 in front of a goal. For example, practice hockey goaltender 10 may be positioned in front of the goal as shown in dashed lines for a shooter practicing shooting the puck in the typical five areas or holes as described above. Practice hockey goaltender 10 may be positioned forward of the goal (outwardly from the crease or a circular arc marked on the ice in front of goal) and to the side as shown in solid lines for a shooter practicing shooting the puck. For example, in this position, the shooter may practice and obtain the feeling of shooting at the goal while the edge of the goal is obstructed from view by the shooter by the practice hockey goaltender. It will be appreciated that the practice hockey goaltender may be used in a plurality of different positions. For example, a practice session may require offensive players to take turns in shooting from a specified point corresponding to the position selected for the practice hockey goaltender. The practice hockey goaltender may allow shooter to quickly develop proper shooting skills.

It is to be understood that the above description is intended to be illustrative, and not restrictive. For example, the above-described embodiments and/or aspects thereof may be used in combination with each other. In addition, many modifications may be made to adapt a particular situation or material to the teachings of the various embodiments without departing from their scope.

While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the disclosure has been described in detail in connection with only a limited number of embodiments, it should be readily understood that the disclosure is not limited to such disclosed embodiments. Rather, the disclosure can be modified to incorporate any number of variations, alterations, substitutions, or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

This written description uses examples in the present disclosure, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A freestanding practice hockey goaltender generally fixedly positionable on a playing surface in front of a hockey goal, said practice hockey goaltender comprising:

a generally three-dimensional life-size representation of a hockey goaltender disposed in a playing position having a front side, a rear side, a bottom side, and at least one support defining a portion of said bottom side extending outwardly from said rear side;

said generally three-dimensional life-size representation representing a three-dimensional life-size padded left leg, a three-dimensional life-size padded right leg, a three-dimensional hockey stick, a three-dimensional life-size blocker, a three-dimensional life-size catcher, a three-dimensional torso, and a three-dimensional mask;

said bottom side having a forwardly and upwardly-extending bottom surface portion disposed generally under said padded left leg and said padded right leg, and a rearwardly and upwardly-extending bottom surface portion disposed generally under said at least one support, said forwardly and upwardly-extending bottom surface portion and said rearwardly and upwardly-extending bottom surface portion define a ridge therebetween;

a first plurality of spikes downwardly-dependable from said forwardly and upwardly-extending bottom surface portion in front of said ridge under said padded left leg and said padded right leg, and a second plurality of spikes downwardly-dependable from said rearwardly and upwardly-extending bottom surface portion behind said ridge under said at least one support and outwardly from said rear side, said spikes operable for engaging the playing surface; and wherein the bottom surface portion and said plurality of spikes operable to maintain said practice hockey goaltender in freestanding fixed upright position on the playing surface when impacted by a hockey puck shot by a player.

2. The freestanding practice hockey goaltender of claim 1 wherein said first plurality of spikes and said second plurality of spikes are disposable generally normal to said forwardly and upwardly-extending bottom surface portion and to said rearwardly and upwardly-extending bottom surface portion.

3. The freestanding practice hockey goaltender of claim 1 wherein said practice hockey goaltender comprises a weight distribution to the front so that when said practice hockey goaltender without said plurality of spikes is used on a paved playing surface, said practice hockey goaltender is generally supported upright and resting on said forwardly and upwardly-extending bottom surface portion.

4. The freestanding practice hockey goaltender of claim 1 wherein said padded left leg, said padded right leg, said hockey stick, said blocker, said catcher, said torso, and said mask comprise planar forward facing surfaces disposed on a non-vertical angle when said practice hockey goaltender is supported and used on the playing surface.

5. The freestanding practice hockey goaltender of claim 1 wherein said at least one support comprises a pair of spaced-apart supports.

6. The freestanding practice hockey goaltender of claim 5 wherein said practice hockey goaltender and a second inverted practice hockey goaltender are compactly nestable together with said rear sides disposed side-by-side and with said mask of one practice hockey goaltender being disposed between said supports of said other practice hockey goaltender.

7. The freestanding practice hockey goaltender of claim 1 wherein said forwardly and upwardly-extending bottom surface portion and said rearwardly and upwardly-extending bottom surface portion define generally planar surfaces, generally convex surfaces, and/or combinations thereof.

8. The freestanding practice hockey goaltender of claim 1 wherein:

said generally three-dimensional life-size representation having the appearance of being formed from a three-dimensional life-size left padded leg plate-like element, a three-dimensional life-size right padded leg plate-like element, a three-dimensional hockey stick plate-like element, a three-dimensional life-size blocker plate-like element, a three-dimensional life-size catcher plate-like element, a three-dimensional torso plate-like element, and a three-dimensional life-size mask plate-like element;

said generally three-dimensional life-size representation having a height of about 50 inches to about 60 inches and a width of about 45 inches to about 55 inches;

said mask plate-like element having a front surface, said blocker plate-like element having a front surface, said catcher plate-like element having a front surface, said left padded leg plate-like element having a front surface, said right padded leg plate-like element having a front surface, and each of said front surfaces being offset from a front surface of said torso plate-like element;

said left padded leg plate-like element defines a ledge extending between said front surface of said left padded leg plate-like element and said front surface of said torso plate-like element, and said right padded leg plate-like element defines a ledge between a front surface of said right padded leg plate-like element and said front surface of said torso plate-like element; and said left padded leg plate-like element and said right padded leg plate-like element having a thickness of about 5 inches to about 10 inches, and said torso plate-like element having a thickness of about 1 inch to about 3 inches.

9. The freestanding practice hockey goaltender of claim 8 wherein said generally three-dimensional life-size representation comprises a height of about 54 inches and a width of about 48 inches, said left padded leg plate-like element and said right padded leg plate-like element comprises a thickness of about 7 inches, and said torso plate-like element comprises a thickness of about 2 inches.

10. The freestanding practice hockey goaltender of claim 8 wherein said mask plate-like element comprises a generally flat vertical forward facing surface and a peripherally-extending side disposed generally normal to said generally flat vertical forward facing surface.

11. The freestanding practice hockey goaltender of claim 10 wherein said generally flat vertical forward facing surface of said mask plate-like element is spaced about 4 inches from a forward facing surface of said torso plate-like element.

12. The freestanding practice hockey goaltender of claim 8 wherein said ledges comprises a depth of about 3 inches.

13. The freestanding practice hockey goaltender of claim 8 wherein torso plate-like element comprises a generally concave forward facing surface.

14. The freestanding practice hockey goaltender of claim 8 wherein said plurality of plate-like elements comprise substantially flat vertical forward facing surfaces, and some of said substantially flat vertically forward facing surfaces being offset each other.

15. The freestanding practice hockey goaltender of claim 8 wherein said generally three-dimensional life-size representation comprises spaced-apart supports extending outwardly from said rear side of said left padded leg plate-like element and from said right padded leg plate-like element.

16. The freestanding practice hockey goaltender of claim 15 wherein said plurality of spaced-apart supports comprises a plurality of triangular plate-like elements.

17. The freestanding practice hockey goaltender of claim 8 further comprising a plurality of spikes attachable to the bottom surface portions.

18. The freestanding practice hockey goaltender of claim 1 wherein:

said front side, said rear side, and a peripherally-extending side disposed between said front side and said rear side comprises a surrounding monolithic structure having an outer wall defining a hollow cavity therein.

19. The freestanding practice hockey goaltender of claim 18 wherein said outer wall generally comprises a wall thickness of about 3 millimeters to about 5 millimeters.

20. The freestanding practice hockey goaltender of claim 19 wherein said surrounding outer wall is formed by rotational molding.

21. The freestanding practice hockey goaltender of claim 18 wherein said padded left leg and padded right leg of said generally three-dimensional life-size representation comprises an outer thickness about 7 inches, said torso of said generally three-dimensional life-size representation comprises an outer thickness of about 2 inches.

22. The freestanding practice hockey goaltender of claim 21 wherein said mask of said generally three-dimensional life-size representation comprises an outer thickness of about 6 inches.

23. The freestanding practice hockey goaltender of claim 18 wherein at least about 50-percent of the weight of the practice hockey goaltender is disposed below a waist of the three-dimensional life-size representation.

24. A method of simulating a hockey goaltender comprising the freestanding practice hockey goaltender of claim 1, said method comprising:

providing a hockey goal; and providing the freestanding practice hockey goaltender disposed in front of the hockey goal.

25. The method of claim 24 further comprising shooting pucks at the practice hockey goaltender disposed in front of the hockey goal.

26. The method of claim 25 further comprising moving the practice hockey goaltender to different positions in front of the goal to provide realistic angles and views for shooting pucks at the practice hockey goaltender disposed in front of the hockey goal.

27. A method of simulating a hockey goaltender comprising the freestanding practice hockey goaltender of claim 8, said method comprising:

providing a hockey goal; and providing the freestanding practice hockey goaltender disposed in front of the hockey goal.

28. The method of claim 27 further comprising shooting pucks at the practice hockey goaltender disposed in front of the hockey goal.

29. The method of claim 28 further comprising moving the practice hockey goaltender to different positions in front of the goal to provide realistic angles and views for shooting pucks at the practice hockey goaltender disposed in front of the hockey goal.

30. A method of simulating a hockey goaltender comprising the freestanding practice hockey goaltender of claim 18, said method comprising:

providing a hockey goal; and providing the freestanding practice hockey goaltender disposed in front of the hockey goal.

31. The method of claim 30 further comprising shooting pucks at the practice hockey goaltender disposed in front of the hockey goal.

32. The method of claim 31 further comprising moving the practice hockey goaltender to different positions in front of the goal to provide realistic angles and views for shooting pucks at the practice hockey goaltender disposed in front of the hockey goal.

* * * * *